United States Patent [19]

Larkey

[11] 4,273,336

[45] Jun. 16, 1981

[54] GOLF SWING AID

[75] Inventor: Orval W. Larkey, Thousand Oaks, Calif.

[73] Assignee: J. T. Posey Company, Arcadia, Calif.

[21] Appl. No.: 148,162

[22] Filed: May 8, 1980

[51] Int. Cl.[3] ..... A63B 69/36

[52] U.S. Cl. ..... 273/189 R; 128/133

[58] Field of Search ..... 273/165, 166, 189 R, 273/189 A, 188 R, 26 C, 29 A, 183 B; 128/169, 133; 272/67; 2/161 A

[56] References Cited

U.S. PATENT DOCUMENTS

| | | | |
|---|---|---|---|
| 653,814 | 7/1900 | Mennes | 273/54 B UX |
| 2,425,489 | 8/1947 | Peterson | 273/189 R |
| 2,684,065 | 7/1954 | Umbenhower | 128/133 |
| 2,852,779 | 9/1958 | Roessler | 2/161 A |
| 3,957,267 | 5/1976 | Vitalo | 273/166 X |

OTHER PUBLICATIONS

"Golf Digest", Nov. 1974, p. 68 relied on.

*Primary Examiner*—George J. Marlo
*Attorney, Agent, or Firm*—Christie, Parker & Hale

[57] ABSTRACT

A golf swing aid fits around the wrists of a golfer and assists in keeping the golfer's wrists together during a golf swing. The golf swing aid comprises a first wrist strap having cooperating fasteners at opposite ends for releasably securing it around a golfer's wrist. An elastically stretchable second wrist strap overlies the first strap and its opposite ends are secured to the first strap to form an elastically stretchable loop that faces the golfer's other wrist. The second strap can be stretched to loop around the golfer's other wrist when the golfer grips a golf club. The second strap, when looped around the golfer's other wrist, stays under tension to provide an elastic return force that resists any tendency of the golfer to separate his wrists during a golf swing.

5 Claims, 4 Drawing Figures

GOLF SWING AID

FIELD OF THE INVENTION

This invention relates to a golf swing aid that can be releasably secured around the wrists of a golfer to assist the golfer in keeping his wrists together when swinging a golf club.

BACKGROUND OF THE INVENTION

The correct grip of the hands on a golf club is essential for good golf playing. Both hands should be placed together and stay together, working in unison during the golf swing for full control and power. A common fault among golf players is allowing their wrists to become separated during the golf swing. If the wrists separate the golfer can lose control of the swing and mis-hit the ball.

SUMMARY OF THE INVENTION

This invention provides a golf swing aid that can be fastened around the wrists of a golfer and during the golf swing assist the golfer in keeping his wrists together.

Briefly, the golf swing aid includes a flexible first strap having fasteners for releasably securing the first strap in a first loop around a first wrist of a golfer. An elastically stretchable second strap is fastened to the first strap to form an elastically stretchable second loop that faces the golfer's second wrist when the first strap is secured to the golfer's first wrist. The second loop is under tension when secured around the golfer's second wrist. This provides an elastic return force that resists the tendency of one wrist to separate from the other during a golf swing. The golf swing aid can be used as a practice device to assist the golfer in holding his wrists together when swinging the golf club, and thereby can improve the golfer's ability.

These and other aspects of the invention will be more fully understood by referring to the following detailed description and the accompanying drawing.

DRAWING

DETAILED DESCRIPTION

Figure 1:
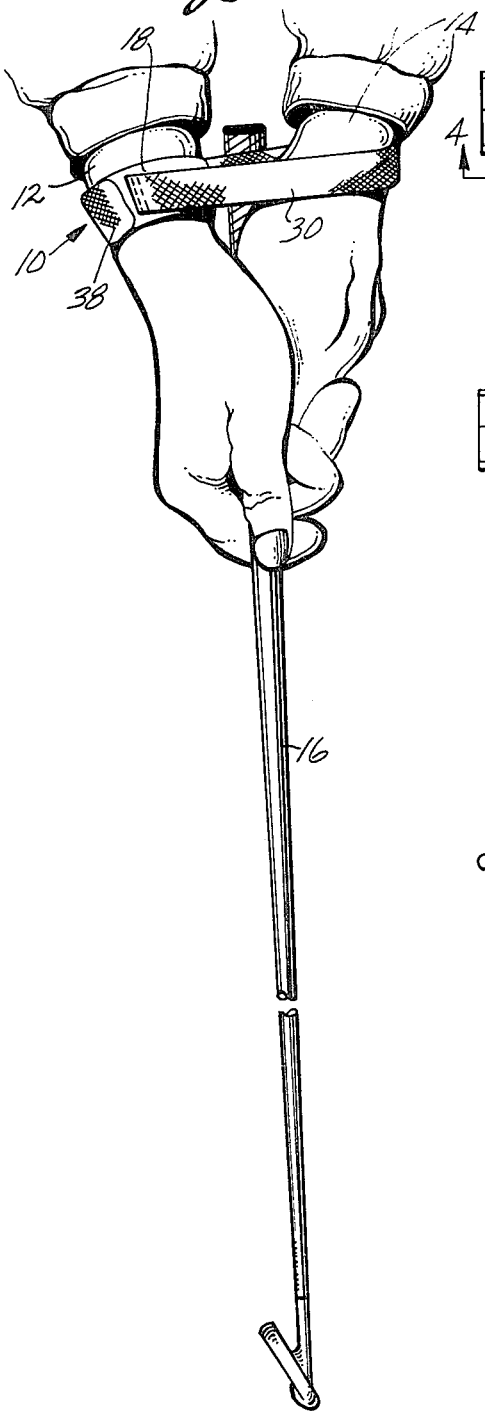
FIG. 1 is a fragmentary perspective view showing use of a golf swing aid, according to principles of this invention, attached around the wrists of a golfer gripping a golf club.

FIG. 1 shows a golf swing aid 10 secured around first and second wrists 12 and 14 of a golfer's hands when the golfer is gripping a golf club 16.

Figure 2:
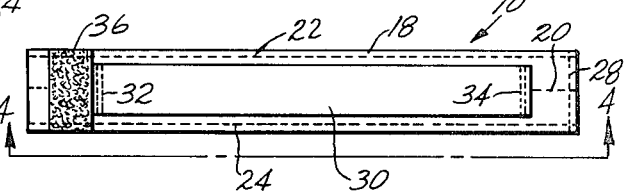
FIG. 2 is an elevation view showing one face of the golf swing aid.
Figure 3:
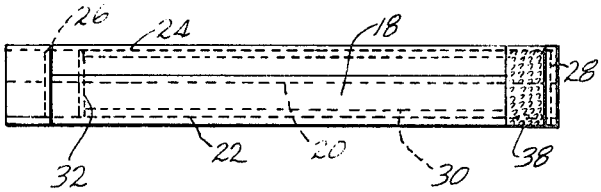
FIG. 3 is an elevation view showing an opposite face of the golf swing aid from the face shown in FIG. 2.

Referring to FIG. 2, the golf swing aid includes an elongated, flexible and foldable first strap 18. The first strap can be made from various flexible fiber-woven fabrics such as cotton or nylon. Although other arrangements can be used, in one embodiment the flexible first strap is of double-thickness cotton fabric made by overlapping opposite portions of the fabric and securing the overlapping portions by stitching 20 along the center line of the resulting strap. Lengthwise edge stitching 22 and 24 also is provided inboard opposite edges of the first strap. Opposite ends of the resulting first strap are overlapped and fastened by end stitching 26 and 28. The resulting first strap 18 is flexible, in the sense that it is compliant, or non-rigid, and is foldable; but the first strap has longitudinal rigidity, in the sense that it is substantially non-stretchable when a longitudinal force is applied to it.

Figure 4:
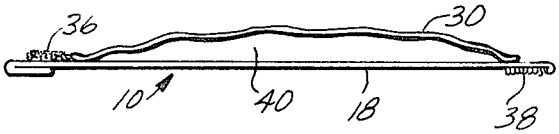
FIG. 4 is a side elevation view taken on line 4—4 of FIG. 2.

FIG. 2 illustrates an outside face of the first strap. An elongated elastically stretchable second strap 30 overlies the outside face of the first strap. The second strap extends most of the length of the first strap. Longitudinally spaced apart end stitching 32 and 34 rigidly fastens opposite ends of the elastic second strap to the first strap. The length of the second strap is longer between its fixed ends than the length of the adjacent portion of the first strap, so that the second strap loosely overlies the first strap, as illustrated best in FIG. 4. The second strap cooperates with the first strap to form a second loop 40 between them.

Means are provided for releasably securing opposite ends of the first strap to each other for form a first loop. Although other fastening means can be provided, in the illustrated embodiment, a first fastener 36 is secured to the outside face of the first strap between one end of the first strap and the point at which a corresponding end of the second strap is fastened to the first strap. A second fastener 38 is secured to the opposite inside face of the first strap at the end opposite the first fastener 36. In the illustrated embodiment, the fasteners 36 and 38 comprise cooperating flexible strips of thistle-cloth material, preferably the type sold under the trademark Velcro. The first fastener is a strip of Velcro pile material and the second fastener is a strip of Velcro hook material. The fasteners 36 and 38 are secured to opposite ends of the first strip by stitching.

In using the golf swing aid 10, the first strap is placed around the first wrist 12 of the golfer, and the fasteners 36 and 38 are pressed into frictional contact with each other so the first strap forms a fixed first loop that makes a snug fit around the golfer's first wrist. Owing to the non-elasticity of the first strap, the first loop is of fixed length around the golfer's first wrist. The first strap is secured so that the elastically stretchable second strap 30 overlies the inside of the golfer's first wrist and faces toward the golfer's second wrist 14. The second loop 40 is elastically stretchable away from the outside face of the fixed first loop formed by the first strap. The golfer then can elastically stretch the second strap away from the first strap to form the second loop 40 through which he can slip his second wrist 14. The elastically stretchable second strap fits around the golfer's second wrist in the manner shown in FIG. 1. In this manner, the second strap elastically stretches to an enlarged size in which the area confined within the second loop is similar to the area within the first loop. When the second loop is so enlarged, it constantly applies tension around the golfer's second wrist. Stated another way, the length of the second strap is such that the opening inside the second loop 40 is normally smaller than the cross-sectional area of the golfer's wrist, i.e., smaller than the cross-sectional area of the fixed first loop. The elastically stretchable second loop is therefore under tension when the first and second straps are around the golfer's first and second wrists, respectively, as shown in FIG. 1. The second strap therefore constantly applies a contractile force around the golfer's second wrist, which elastically resists any tendency to separate one wrist from the other. Thus, if one wrist is pulled away from the other wrist, it is done so against the bias of the second strap which stretches elastically to allow the two wrists to separate, but constantly applies an elastic return force tending to urge the wrists back together. Thus, during a golf swing, the two straps work in unison to apply to one wrist a light amount of tension that resists any tendency to separate the wrists and assists the golfer in keeping his wrists together throughout the stroke. In this way, the golf aid can result in more control over the golf swing.

I claim:

1. A golf swing aid comprising an elongated first strap; fastening means for releasably securing opposite end portions of the first strap to form a first loop that makes a snug fit around the first wrist of a golfer; an elastically stretchable second strap overlying the first strap and fixed at opposite end portions to the first strap, the second strap cooperating with the first strap to form a second loop between them; the elastically stretchable second strap being stretchable away from the first strap to enlarge the enclosed area within the second loop to a size comparable to the enclosed area within the first loop in order to accommodate the second wrist while both hands are gripping a golf club, the second strap being under tension when forming said enlarged second loop.

2. Apparatus according to claim 1 in which the elastically stretchable second loop is rigidly affixed at opposite ends to the first strap and the second strap is longer between its fixed ends than the length of the corresponding adjacent portion of the first strap.

3. Apparatus according to claim 2 in which the ends of the second strap are fastened to locations inboard the opposite ends of the first strap; and including first and second fastening means secured to opposite first and second faces of the first strap between the ends of the first strap and the points at which the second loop is attached to the first strap.

4. Apparatus according to claim 3 in which the fastening means comprise cooperating thistle-cloth fasteners.

5. Apparatus according to claim 1 in which the first strap is flexible and foldable, but substantially rigid longitudinally.

* * * * *